US006902662B2

(12) United States Patent
Eaton et al.

(10) Patent No.: US 6,902,662 B2
(45) Date of Patent: Jun. 7, 2005

(54) METHOD OF REDUCING HYDROLYSIS IN HYDROCARBON STREAMS

(75) Inventors: Paul Eugene Eaton, Houston, TX (US); Petrous Johannes Venter, Pearland, TX (US); George Burton Jones, Fort McMurray (CA)

(73) Assignee: Champion Technologies, Inc., Fresno, TX (US)

( * ) Notice: Subject to any disclaimer, the term of this patent is extended or adjusted under 35 U.S.C. 154(b) by 242 days.

(21) Appl. No.: 10/369,396

(22) Filed: Feb. 21, 2003

(65) Prior Publication Data

US 2003/0201207 A1 Oct. 30, 2003

Related U.S. Application Data

(60) Provisional application No. 60/376,631, filed on Apr. 30, 2002.

(51) Int. Cl.[7] ..... C10G 17/02; C10G 19/02

(52) U.S. Cl. ..... 208/47; 208/262.1; 208/263; 208/279; 208/281; 208/283; 208/284; 208/265; 508/461

(58) Field of Search ..... 208/47, 262.1, 208/263, 265, 279, 281, 283, 284; 508/461

(56) References Cited

U.S. PATENT DOCUMENTS

| | | | |
|---|---|---|---|
| 2,616,904 | A | 11/1952 | Asseff et al. |
| 2,695,910 | A | 11/1954 | Asseff et al. |
| 3,312,618 | A | 4/1967 | Le Suer et al. |
| 4,163,728 | A | 8/1979 | Cheng et al. |
| 5,858,208 | A | 1/1999 | Flanders et al. |

*Primary Examiner*—Walter D. Griffin
*Assistant Examiner*—Tam M. Nguyen
(74) *Attorney, Agent, or Firm*—C. James Bushman; Browning Bushman P.C.

(57) ABSTRACT

A method of reducing hydrolysis in a hydrocarbon stream comprising adding to a hydrocarbon stream containing a chloride compound which undergoes hydrolysis at elevated temperatures in the presence of water to form hydrochloric acid, an effective amount of a treating agent that is at least one overbased complex of a metal salt and an organic acid complexing agent, the treating agent being added to hydrocarbon stream when the stream is at a temperature below which any substantial hydrolysis of the chloride containing compound occurs.

16 Claims, 5 Drawing Sheets

METHOD OF REDUCING HYDROLYSIS IN HYDROCARBON STREAMS

RELATED APPLICATIONS

The application claims the benefit of and incorporates by reference Provisional Application Ser. No. 60/376,631, filed Apr. 30, 2002

BACKGROUND OF THE INVENTION

1. Field of the Invention

This invention relates to reducing hydrolysis of hydrocarbon streams such as crude oil that are subjected to processing at elevated temperatures and, more particularly, to reducing hydrolysis and the subsequent production of hydrochloric acid by the addition of hydrolysis inhibitors to such streams.

2. Description of Prior Art

A typical refinery includes a tank farm or storage area where feed stocks, e.g., crude oil, shale oil, coal oil and certain intermediate hydrocarbon streams from the refining processes are stored for optimum utilization in the refinery. It is not uncommon for these feedstocks to contain chloride salts, primarily metal chloride salts and, more particularly, chlorides of alkali and alkaline earth metals in amounts ranging from 1 to 2000 ppm. It is known that hydrocarbon streams containing these chloride contaminants, at elevated temperatures and in the presence of water, will hydrolyze to form hydrochloric acid, which, as well known to those skilled in the art, can cause severe corrosion problems to processing equipment.

In a typical refinery the crude is generally first treated in a desalter. The purpose of the desalter is to remove as much of the salts and other water soluble contaminants as possible prior to introducing the hydrocarbon stream, e.g., the crude oil, to the downstream heat exchangers, furnaces, distillation columns, crackers and the associated processing equipment such as pumps, valves, piping and other equipment commonly used in refineries and other petrochemical facilities. It is common for the feed to the desalter to be preheated, generally to a temperature of about 200° to 250° F. After the feedstock has passed through the desalter, which generally operated at a temperature of 200° to 250° F., it passes through a second heating zone operated at a temperature of about 250° to 600° F. The heated stream then passes to a furnace where it is heated to a temperature of 600° to 700° F. The stream is next introduced into an atmospheric distillation column together with steam to make a rough fractionation into generally four cuts: an overhead stream containing light hydrocarbon, e.g., $C_1$ to $C_8$ hydrocarbon, a first intermediate fraction comprising kerosene, jet and diesel fuel, a second intermediate fraction containing gas oil, and a bottoms fraction containing the heaviest components present in the feedstock. As noted, it is common practice to stream strip the crude in the atmospheric distillation, column. Thus, any hydrochloric acid formed upstream of the atmospheric distillation column will be carried over in the light fraction and be condensed with water. Subsequent treatment of this condensed fraction will result in the hydrochloric acid coming in contact with and causing corrosive damage to process equipment used to treat the condensed fraction.

The usual method for dealing with the overhead corrosion resulting from the hydrolysis reaction is to apply neutralizers and corrosion inhibitors. These inhibitors are costly and in many instances cause foaming and deposition problems which can be more damaging than the corrosion problem.

SUMMARY OF THE INVENTION

According to a preferred aspect of the present invention there is provided a method for reducing hydrolysis in a hydrocarbon stream wherein a hydrocarbon stream containing a chloride compound which undergoes hydrolysis at elevated temperatures and in the presence of water to form hydrochloric acid is treated with an effective amount of a treating agent comprising at least one overbase complex of a metal salt and an organic acid complexing agent. Preferably, the treating agent is introduced into the hydrocarbon stream when the stream is at a temperature below which any substantial hydrolysis of the chloride containing compound occurs.

DESCRIPTION OF PREFERRED EMBODIMENTS

Figure 1:
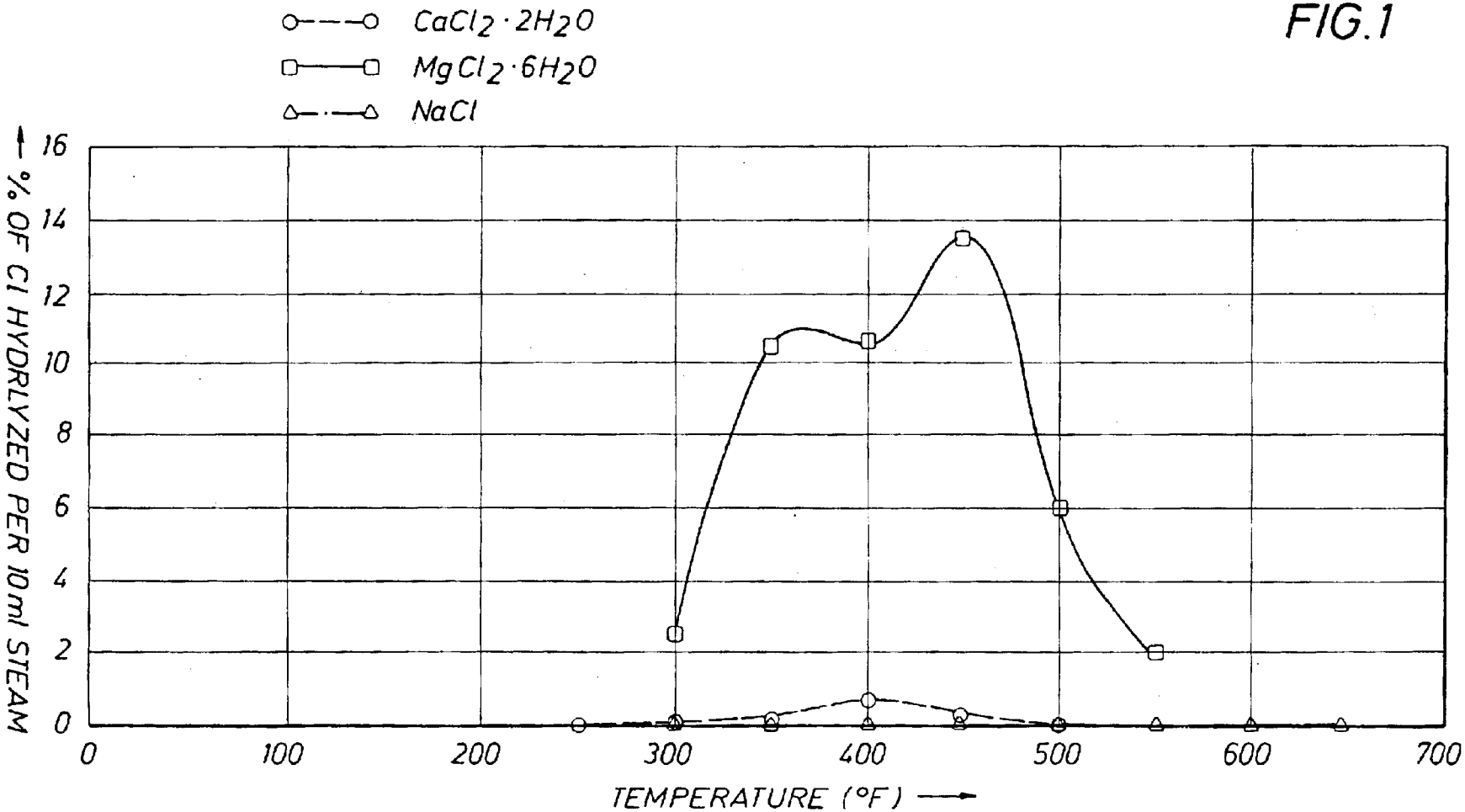
FIG. 1 is a graph showing the hydrolysis of various metal chlorides in mineral oil as a function of temperature.

The method of the present invention, while finding particular application to crude feedstocks in refinery operations, can be used in any hydrocarbon stream and any process wherein the hydrocarbon stream contains hydrolyzeable chloride compounds, which, at elevated temperatures and in the presence of water can form hydrochloric acid. Non-limiting examples of suitable hydrocarbon streams include crude oil, shale oil, coal oil, as well as various hydrocarbon streams that are produced in refinery operation and that are generally used as intermediates to produce other, more desirable products. The chloride containing compounds can be any compound, generally inorganic in nature, that will hydrolyze at elevated temperatures and in the presence of water to form hydrochloric acid. Usually, the chloride containing compounds are metal salts and, more particularly, salts of the alkali and alkaline earth metals, such as sodium chloride, calcium chloride, magnesium chloride, etc. As noted above, it has been found that if a treating agent comprised of an overbase complex of a metal salt and an organic acid complexing agent, described hereafter, is introduced into the chloride contaminated hydrocarbon streams prior to the stream being raised to a range at which any significant hydrolysis occurs, hydrolysis of the resulting chloride is greatly diminished, often to a point where minimal corrosion occurs.

The hydrolysis of the chloride containing compounds to form hydrochloric acid occurs generally over a temperature range depending upon the specific conditions, the particular chloride(s) and other such variables. Generally, however, significant hydrolysis usually does not occur until the temperature of the hydrocarbon stream reaches about 300° F. although, again, depending upon the chloride compound and other conditions, some hydrolysis can occur at temperatures as low as 250°. Accordingly, while no precise temperature can be specified because of the variables noted above, in general, the treating agent would be introduced into the hydrocarbon stream when the stream is at a temperature below about 400° F. Using as an example the case of a refinery operation as described above wherein a crude feedstock passes through a first preheating section, a desalter, a second heating section and then into a furnace prior to being introduced into an atmospheric distillation column, since the second heating section raises the temperature of the feed to a range of around 250° to 600° F., significant hydrolysis of the chloride contaminants will occur at this point. Accordingly, the treating agent of the present invention is preferably introduced into the feed stream prior to the time the stream enters the second heating section, i.e., the heating section following the desalter and upstream of the furnace. It will be appreciated, however, that the treating agent can be introduced well downstream of the second heating section and, indeed, can be introduced with the crude that may be an ambient or below ambient temperatures, i.e., prior to the first preheating section. Thus, there are numerous injections points commencing with the point of introduction of the crude into the refinery operation up to the point, generally before the heating system, downstream of the desalter and before the furnace where the temperature is still low enough that no significant hydrolysis has occurred and accordingly, where the treating agent can be introduced to prevent such hydrolysis. It is also possible that the treating agent can be introduced into the heating section between the desalter and the furnace, although it is preferable that it be introduced prior to the stream entering the second heating section.

It is also believed that the method of the present invention is applicable to reducing naphthenic acid corrosion, a recognized phenomena in refinery operations. Naphthenic acid corrosion generally occurs in the temperature range of from 400° to 600° F., i.e., at a temperature significantly higher than that at which hydrolysis of the chloride contaminant occurs. Thus, and again with reference to the general outline above, if the treating agent is introduced into the stream at some point prior to the stream entering the second heating section, i.e., the heating section between the desalter and the furnace, it would be effective at reducing naphthenic acid corrosion, as well as hydrolysis of the chloride contaminants. It should also be noted, as shown hereafter, that naphthenic acid greatly increases the hydrolysis of chloride salts such as sodium chloride.

As described in U.S. Pat. No. 5,858,208, the treating agent used in this invention, as noted, comprises at least one overbase complex of a salt and an organic acid complexing agent. The exact structure of overbases is not well understood. It has been suggested that they comprise dispersions of salts formed by contacting an acidic material with an excess of a basically reacting metal compound; e.g., a metal hydroxide or oxide. Alternatively, it has been suggested that they comprise "polymeric salts". It is believed that neither theory is incorrect but that neither is completely correct. In accordance with the present invention, it is believed that the preparation of an "overbased" material results in an "overbase complex" of a metal oxide or carbonate with an organic acid dispersant or stabilizer; i.e., "complexing agent". The nature of the complex so formed is not completely understood.

Accordingly, as used in the present specification, the treating agent is an overbase complex of an oxide or carbonate of Mg, Ca, Ba, Sr or Mn and the Mg, Ca, Ba, Sr or Mn salt of an organic acid "complexing agent". In this application, it has been found that the magnesium species yields especially effective results and it is theorized that aluminum species alone or in combination with Mg would yield good results as well. Thus, as contemplated herein, overbases include the aluminum species. The treating agent contains a stoichiometric excess of basic metal compound, relative to the number of equivalents of acid complexing agent which is reacted with a basic metal compound to afford the complex, relative to the normal stoichiometry of the particular metal base and acid. For example, a "neutral" or "normal" metal salt of an acid is characterized by an equivalent ratio of base or "metal" to acid of 1:1, while an overbased salt is characterized by a higher ratio; e.g., 1.1:1, 2:1, 5:1, 10:1, 15:1, 20:1, 30:1 and the like. The term "metal ratio" is used to designate the ratio of (a) equivalents of metal or base to acid in an overbased salt to (b) the number of equivalents expected to be present in a normal salt, based on the usual stoichiometry of the metal or metals involved and the acid of acids present. Thus, an oil dispersion of an overbased magnesium salt containing two equivalents of acid and twenty equivalents of magnesium would have a metal ratio of 10; i.e., 20/(1+1).

In the present specification, magnesium, for example, is regarded as having two equivalents of base per atomic weight; magnesium oxide (MgO) and magnesium hydroxide ($Mg(COH_2)$, two equivalents per mole. Monobasic organic acids are regarded as having one equivalent of acid per acidic hydrogen or acid group. Thus, a monocarboxylic acid or monosulfonic acid or their equivalent derivatives, such as esters and ammonium and metal salts, have one equivalent per mole of acid, ester or salt; a disulfonic acid or dicarboxylic acid, or equivalent derivative, has two equivalents per mole. The basically reacting metal compounds such as the oxides and carbonates of calcium, barium and magnesium have two equivalents per mole; i.e., two equivalents per atomic weight of metal.

The treating agents used in the method of the present invention are overbase complexes of metal oxides and/or carbonates and a metal salt of at least one complexing agent. The oxides or carbonates may also be a combination of the metal species, such as a 1:1 by weight mixture. Likewise, the salt may be a combination of metal salts, such as a 1:1 by weight mixture. However, the magnesium, calcium or aluminum species are highly preferred.

Hereinafter, the term "carboxylate" refers to the reaction product of a metal base and an organic carboxylic acid having the general formula R—COOH, where R is a hydrocarbon radical, and "non-carboxylate" refers to the reaction product of a metal base and an organic acid other than an organic carboxylic acid; e.g., "non-carboxylic" acids such as organic sulfur acids and organic phosphorus acids, which latter materials have substantially greater dispersant capabilities than do the carboxylates, the carboxylates, however, having stabilizing capabilities.

The role of the complexing agent in the preparation and use of the treating agents in the invention is not clear. As stated above, some may function as stabilizers while others may function as dispersants. Certainly, some may have both functions or another, unknown, function. It appears, however, that, during the preparation of the complex, the presence of at least one complexing agent is essential to provide the treating agent used in the method of the invention. It also appears that the preferred treating agents are characterized by the presence of a non-carboxylate salt; e.g., a sulfonate.

The treating agents used in the present invention may be prepared in any manner known to the prior art for preparing overbased salts, providing that the magnesium oxide/magnesium carboxylated overbase complex resulting therefrom is in the form of finely divided, preferably submicron, particles which form a stable dispersion in oil. Thus, the method for preparing the magnesium oxide/magnesium carboxylated overbase complex is to form a mixture of a base of the desired metal; e.g., $Mg(OH_2)$, a complexing agent; e.g., fatty acid such as a tall oil fatty acid, which is present in a quantity much less than that required to stoichiometrically react with the hydroxide, and a non-volatile diluent. The mixture is heated to a temperature of about 250° to 350° C., whereby there is afforded the overbase complex of the metal oxide and metal salt of the fatty acid as set forth in U.S. Pat. No. 4,163,728 (the '728 patent). The metal carbonate/complexing agent overbase complex; e.g., magnesium carbonate/magnesium sulfonate, is commercially available or may be prepared in the same manner as described above, except that carbon dioxide is bubbled through the initial reaction mixture.

The above-described method of preparing the overbased magnesium oxide/magnesium carboxylate treating agent used in the present invention is particularly set forth in the '728 patent, which is incorporated herein by reference in its entirety and made a part hereof, wherein, for example, a mixture of $Mg(OH)_2$ and a carboxylic acid complexing agent is heated at a temperature of about 280° to 330° C. in a suitable non-volatile diluent.

Complexing agents are carboxylic acids, phenols, organic phosphorus acids and organic sulfur acids. Included are those acids which are presently used in preparing overbased materials; e.g., those described in U.S. Pat. Nos. 3,312,618; 2,695,910 and 2,616,904, and constitute an art-recognized class of acids. The carboxylic acids, phenols, organic phosphorus acids and organic sulfur acids which are oil-soluble per se, particularly the oil-soluble sulfonic acids, are especially useful. Oil-soluble derivatives of these organic acidic substances, such as their metal salts, ammonium salts and esters (particularly esters with lower aliphatic alcohols having up to six carbon atoms, such as the lower alkanols), can be utilized in lieu of or in combination with the free acids. When reference is made to the acid, its equivalent derivatives are implicitly included unless it is clear that only the acid is intended.

Suitable carboxylic acid complexing agents which may be used to make the treating agent include aliphatic, cycloaliphatic and aromatic mono and polybasic carboxylic acids such as naphthenic acids, alkyl- or alkenyl-substituted cyclopentanoic acids, alkyl- or alkenyl-substituted cyclohexanoic acids and alkyl- or alkenyl-substituted aromatic carboxylic acids. The aliphatic acids generally are long chain acids and contain at least eight carbon atoms and preferably at least twelve carbon atoms. The cycloaliphatic and aliphatic carboxylic acids can be saturated or unsaturated. Specific examples include 2-ethylhexanoic acid, alpha-linolenic acid, propylene-tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentane carboxylic acid, myristic acid, dilauryldecahydronaphthalene carboxylic acid, stearyl-octahydroindene carboxylic acid, palmitic acid, commercially available mixtures of two or more carboxylic acids such as tall oil fatty acids, rosin acids and the like. Also included as representative acids are saturated aliphatic monocarboxylic acids; e.g., formic, acetic, propionic, butyric, valeric, caproic, heptanoic, caprylic, pelargonic, capric, undecyclic, lauric, tridecylic, myristic, isoacetic, palmitic, margaric and stearic; alicyclic unsaturated monocarboxylic acids; e.g. hydnocarpic and chaulmoogric; saturated aliphatic dicarboxylic acids; e.g., oxalic, malonic, succinic, glutaric, adipic, pimelic, suberic, azelaic and sebacic; alicyclic saturated dicarboxylic acids; e.g., cyclohexane dicarboxylic acid; unsaturated aliphatic monocarboxylic acids; e.g., acrylic, crotonic, decenoic, undecenoic, tridecenoic, pentadecenoic, oleic, linoleic and linolenic; unsaturated dicarboxylic acids; e.g., fumaric and maleic.

Aromatic acids which are used in the preparation of the treating agent are represented by the general formula:

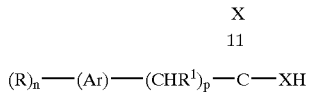

$$(R)_n\text{—}(Ar)\text{—}(CHR^1)_p\text{—}\overset{\overset{X}{\|}}{C}\text{—}XH$$

where R is a hydrocarbon or essentially hydrocarbon radical containing at least four aliphatic carbon atoms, R' is hydrogen or C(X)XH, n is an integer of from one to four, Ar is a polyvalent aromatic hydrocarbon radical having a total of up to fourteen carbon atoms in the aromatic nucleus, each X is independently a divalent sulfur or oxygen group and p is zero or an integer of from one to six, with the proviso that R and n are such that there is an average of at least eight aliphatic carbon atoms provided by the R substituents for each acid molecule represented. Examples of aromatic radicals represented by the variable Ar are the polyvalent aromatic radicals derived from benzene, naphthalene, anthracene, phenanthrene, indene, fluorene, biphenyl and the like. Generally, the radical represented by Ar will be a polyvalent radical derived from benzene or naphthalene such as phenylenes and naphthalene; e.g., methylphenylenes, mercaptophenylenes, N,N-diethylaminophenylenes, chlorophenylenes, dipropoxynaphthylenes, triethylnaphthylenes, and similar tri-, tetra- and pentavalent radicals thereof.

The R variables are usually hydrocarbon groups, preferably aliphatic hydrocarbon groups such as alkyl or alkenyl radicals. However, the R groups can contain such substituents as phenyl, cycloalkyl; e.g., cyclohexyl, cyclopentyl, etc., and non-hydrocarbon groups such as nitro, amino, halo; e.g., chloro, bromo, etc., lower alkoxy, lower alkyl mercapto, oxo substituents; i.e., ═O, thio groups; i.e., ═S, interrupting groups such as ——NH——, ——O——, ——S—— and the like, provided the essentially hydrocarbon character of the R variable is retained. Examples of R groups include butyl, isobutyl, octyl, nonyl, dodecyl, docosyl, tetracontyl, t-chlorohexyl, 4-ethoxypentyl, 4-hexenyl, 3-cyclohexyloctyl, 4-(p-chlorophenyl)-octyl, 2,3,5,-trimethyl, 4-ethyl-5-methyloctyl and substituents derived from polymerized olefins such as polychloroprenes, polyethylenes, propypropylenes, polyisobutylenes, ethyleneprepylene copolymers, chlorinated olefin polymers, oxidized ethylene-propylene copolymers and the like. Likewise the variable Ar may contain non-hydrocarbon substituents, for example, such diverse substituents as lower alkoxy, lower alkyl mercapto, nitro, halo, alkyl or alkenyl groups of less than four carbon atoms, hydroxy, mercapto and the like.

Another group of aromatic carboxylic acids are those of the formula:

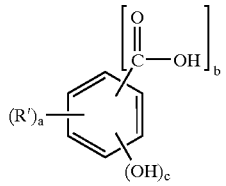

is an aliphatic hydrocarbon radical containing at least four carbon atoms, a is an integer of from 1 to 3, b is 1 or 2, c is zero, 1 or 2 and preferably 1, with the proviso that R' and a are such that the acid molecules contain at least an average of about twelve aliphatic carbon atoms in the aliphatic hydrocarbon substituents per acid molecule.

Phenols which are used include 3,5,5-trimethyl-n-hexyl phenol, decyl phenols, cetyl phenols, nonyl phenols, alkylphenol phenols, resorcinol, octyl catechol, triisobutyl pyrogallol, alkyl alpha naphthol and the like.

Other acids, like the phenols; i.e., "non-carboxylic acids", which may be used in preparing the processing aids are the organic sulfur acids; e.g., oil-soluble sulfonic acids, including the synthetic oil-soluble sulfonic acids. Suitable oil-soluble sulfonic acids are represented by the general formula:

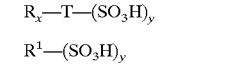

$$R_x—T—(SO_3H)_y \quad \text{I.}$$

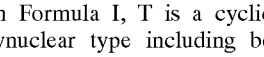

$$R^1—(SO_3H)_y \quad \text{II.}$$

In Formula I, T is a cyclic nucleus of the mono- or polynuclear type including benzenoid, cycloaliphatic or heterocyclic nuclei such as a benzene, naphthalene, anthracene, 1,2,3,4-tetrahydronaphthalene, thianthrene, cyclopentene, pyridine or biphenyl and the like. Ordinarily, however, T will represent an aromatic hydrocarbon nucleus, especially a benzene or naphthalene nucleus. The variable R in the radical $R_x$ can be, for example, an aliphatic group such as alkyl, alkenyl, alkoxy alkoxyalkyl, carboalkoxyalkyl, an aralkyl group or other hydrocarbon or essentially hydrocarbon groups, while x is at least 1 with the proviso that the variables represented by the group $R_x$ are such that the acids are oil-soluble. This means that the groups represented by $R_x$ should contain at least about eight aliphatic carbon atoms and preferably at least about twelve aliphatic carbon atoms. Generally x will be an integer of 1–3. The variables r and y in Formulae I and II have an average value of one to about four per molecule.

The variable R' in Formula II is an aliphatic or aliphatic-substituted cycloaliphatic hydrocarbon or essentially hydrocarbon radical. Where R' is an aliphatic radical, it should contain at least about 8 to about 20 carbon atoms and where R' is an aliphatic-substituted cycloaliphatic group, the aliphatic substituents should contain about 4 to 16 carbon atoms. Examples of R' are alkyl, alkenyl and alkoxyalkyl radicals and aliphatic-substituted cycloaliphatic radicals wherein the aliphatic substituents are alkoxy, alkoxyalkyl, carboalkoxyalkyl, etc. Generally the cycloaliphatic radical will be a cycloalkane nucleus or a cycloalkene nucleus such as cyclopentane, cyclohexane, cyclohexene, cyclopentene and the like. Specific examples of R' are cetyl-cyclohexyl, laurylcyclohexyl, cetyloxyethyl and octadecenyl radicals, and the radicals derived from petroleum, saturated and unsaturated paraffin wax, and polyolefins, including polymerized mono- and diolefins containing from about 1 to 8 carbon atoms per olefin monomer unit. The groups T, R and R' in Formulae I and II can also contain other substituents such as hydroxy, mercapto, halogen, nitro, amino, nitroso, carboxy, lower carbalkoxy, etc., as long as the essentially hydrocarbon character of the groups not destroyed.

The sulfonic acids which are preferred for use herein include alkyl sulfonic acids, alkaryl sulfonic acids, aralkyl sulfonic acids, dialkyl sulfonic acids, dialkylaryl sulfonic acids, aryl sulfonic acids; e.g., ethylsulfonic acid, benzenesulfonic acid, dodecylbenzenesulfonic acid and more complex sulfonic acid mixtures such as mahogany sulfonic acids and petroleum sulfonic acids.

Further, illustrative examples of the sulfonic acids are mahogany sulfonic acids, petrolatum sulfonic acids, mono- and polywax-substituted naphthalene sulfonic acids, cetylchlorobenzenesulfonic acids, cetylphenol sulfonic acids, cetylphenol disulfide sulfonic acids, cetoxycaprylbenzene sulfonic acids, dicetyl thianthrene sulfonic acids, di-lauryl betanaphthol sulfonic acids, dicapryl nitronaphthylene sulfonic acids, paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitrosyl-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids and the like.

As used herein, the terminology "petroleum sulfonic acids" or "petrosulfonic acids" is intended to cover that well-known class of sulfonic acids derived from petroleum products according to conventional processes such as disclosed in U.S. Pat. Nos. 2,490,638; 2,483,800; 2,717,265; 2,726,261; 2,794,829; 2,832,801; 3,225,086; 3,337,613; 3,351,655 and the like. Sulfonic acids falling within Formulae I and II are disclosed in prior U.S. Pat. Nos. 2,616,904; 2,616,905; 2,273,234; 2,723,235; 2,723,236; 2,777,874 and the other U.S. patents referred to in each of these patents. Thus it is seen that these oil-soluble sulfonic acids are well-known in the art and require no further discussion herein.

Organic phosphorus acids used herein are characterized by at least one oil-solubilizing group attached directly to phosphorus via a carbon atom; e.g., oil-soluble phosphoric, phosphinic and phosphonic acids including the oil-soluble thiophosphoric, thiophosphinic and thiophosphonic acids. Preferred phosphorus acids are the alkyl- and dialkyl phosphoric and phosphonic acids and those prepared by reacting olefins with phosphorus sulfides; e.g., phosphorus pentasulfide. Steam-treated reaction products of phosphorus pentasulfide and polyolefins, such as polyisobutylene and polypropylene, are also useful. Such acids are well-known as shown by U.S. Pat. Nos. 2,316,078; 2,315,080; 2,316,091; 2,367,468; 2,375,315; 2,377,955; 2,496,508; 2,507,731; 2,516,119; 2,597,750; 2,647,889; 2,688,612 and 2,915,517.

Of course, mixtures of the above-described organic acids and derivatives thereof may be employed in preparing the treating agents used in the methods of this invention.

Overbase complex types which are the preferred treating agents used in the invention are the following:

MgO/Mg carboxylate $MgCO_3$/Mg carboxylate

MgO/Mg non-carboxylate $MgCO_3$/Mg non-carboxylate

Corresponding aluminum versions are believed to be suitable candidates as well.

The use of the terms "carboxylate" and "non-carboxylate" refers, as stated supra, to the partial reaction product of a base of the desired metal and a carboxylic or non-carboxylic acid complexing agent which affords a complex believed to be a dispersion of finely divided metal oxide (or carbonate) associated with the metal carboxylate or metal non-carboxylate.

Of course, more than one oxide or carbonate may be associated with a complexing agent to afford complexes, for example, of the type $MgO/MgCO_3$/Mg-non-carboxylate, and more than one complexing agent may be combined with an oxide or carbonate to afford complexes, for example, of the type MgO/Mg carboxylate/Mg-non-carboxylate and $MgCO_3$/carboxylate/Mg-non-carboxylate. Corresponding aluminum versions are believed to be possible alternatives.

Additionally, mixed overbase complexes are included; e.g., MgO/Mg carboxylate with MgO/Mg non-carboxylate, $MgCO_3$/carboxylate with $MgCO_3$ non-carboxylate, MgO/Mg carboxylate with $MgCO_3$/non-carboxylate, etc. Again, corresponding aluminum versions are believed to be possibilities as well.

Especially preferred of the above types are:

MgO/Mg carboxylate $MgCO_3$/Mg sulfonate $MgCO_3$/Mg carboxylate

MgO/Mg sulfonate+$MgCO_3$ Mg carboxylate

MgO/$MgCO_3$ Mg carboxylate

MgO/$MgCO_3$/Mg sulfonate

The most preferred complexes are the following:

MgO/Mg fatty acid carboxylate (especially "tall oil" fatty acid carboxylates)

MgO/Mg benzenesulfonate or dodecylbenzenesulfonate $MgCO_3$/Mg fatty acid carboxylate $MgCO_3$/Mg benzenesulfonate or dodecylbenzenesulfonate MgO/Mg fatty acid carboxylate+MgO/Mg benzenesulfonate or dodecylbenzene sulfonate $MgCO_3$/Mg fatty acid carboxylate+$MgCO_3$/Mg benzenesulfonate or dodecylbenzenesulfonate MgO/$MgCO_3$/Mg fatty acid carboxylate MgO/$MgCO_3$/Mg benzenesulfonate or dodecylbenzenesulfonate The mixed overbase complexes; e.g., MgO/Mg fatty acid carboxylate+$MgCO_3$/Mg benzenesulfonate, are in a weight ratio to each other of from about 0.25/10 to about 10/0.25.

As described in the '728 patent, referred to earlier, the reaction of metal base and acid affords a product which undergoes decomposition to afford minute particles of metal oxide or carbonate in associate with the metal salt of the acid. The minute particles immediately become suspended and stabilized by the metal salt of the acid. The particles of metal oxide or metal carbonate are of a size no greater than about 2 microns in diameter, for example, not greater than about 1 micron but, preferably no greater than about 0.1 micron and, especially, should be less than 0.1 micron in diameter.

As described in the '728 patent, the preparation of a stable, fluid magnesium dispersion comprises decomposing a magnesium carboxylate to MgO in a non-volatile process fluid capable of being heated to the decomposition temperature of the magnesium carboxylate also containing a dispersant capable of retaining the magnesium oxide formed by the decomposition in stable suspension at a temperature greater than about 230° C., the process containing less than a stoichiometric amount of carboxylate, based on $Mg(OH)_2$ or equivalent. The magnesium oxide dispersion can be further reacted, after decomposition, with CO to form $MgCO_3$ dispersions, with water to form $Mg(OH)_2$ dispersions, etc.

The overbases by nature, therefore, are colloidal dispersions that may be added as "liquids" to the hydrocarbon streams as discussed above. Upon addition to the hydrocarbon streams, the overbases have been found to disperse easily and to tend to remain well-dispersed. In this sense, the overbases are "oil-soluble" in that they form well-dispersed colloidal suspensions in the hydrocarbon streams such as crude oil.

The amount of treating agent, which is used will vary, depending on the environment of the area, the type of chloride salt and its concentration in the hydrocarbon stream being treated. Generally, at least about 0.5 ppm by weight of available metal per 1 ppm by weight chloride salt is desired. However, at least 1 ppm by weight available metal per 1 ppm by weight chloride salt is preferred due to possible inefficiencies. In general, an amount of treating agent is used which is effective for reducing hydrolysis. This is referred to herein as an "effective amount". Accordingly, there may be used an amount of from about 5 ppm to about 1,000 ppm or more based on the chloride salt concentration and type contained in the hydrocarbon stream, depending on specific circumstances. Ordinarily, from about 25 ppm to about 500 ppm are effective, especially from about 50 to about 300 ppm.

The concentrations of treating agent discussed above are generally maintained on a continuous basis. Thus, the treating agent is added continuously in an amount necessary to effect a constant concentration of, for example, from about 25 to about 500 ppm, especially from about 50 to about 300 ppm. For certain applications, however, the treating agent may be added in a single dose or on a semi-continuous basis. The treating agent may be added as a liquid or, in the case of addition to a gas stream, as a spray.

Experimental Apparatus

The method of the present invention was studied in a laboratory using a prepared mineral oil and a synthetic crude oil comprised of mineral oil with various contaminants normally found in crude oil. A steam distillation apparatus was assembled for conducting steam distillation of the synthetic crude oil in the range of 300° F. to 650° F. at atmospheric pressure. The synthetic crude oil, in addition to mineral oil and chloride salts contained iron oxide, silica, iron sulfide, drilling mud and naphthenic acids. The contaminants were selected to represent actual field conditions. In this regard, it is known that iron oxide and sulfide are formed when corrosion of upstream equipment occurs. Silicon is commonly produced with crude oil as a result of fractured rock formation. Drilling mud is usually present in crude oil from new production formations or workover wells. Naphthenic acids are found in varying amounts in almost all crude oils.

The metal salts employed were sodium chloride, magnesium chloride and calcium chloride, and were added to the mineral oil as a fine powder and mixed for five minutes in a high speed blender to produce a stable suspension. The hexahydrate form of magnesium chloride and the dihydrate form of calcium chloride were selected since these forms would likely be present in crude oils that had been previously exposed to water. Anhydrous sodium chloride was used because no hydrates of sodium chloride are likely to exist in crude oil.

The oil salt suspension was then heated along with the contaminants to be tested to the test temperature, at which time steam purging was starting at 1 g/min and continued until 10 g of condensate was recovered. The condensate was then analyzed for chloride using mercury nitrate titration and ion chromatography. In all cases, the results are reported as percent of the initial chloride, which was added to the synthetic crude or mineral oil as sodium, calcium or magnesium salt. Steam condensate samples were collected at 50° F. intervals between 300° F. and 650° F. The results are shown in the figures, graphically, as plots of percent of total chloride added per 10 g steam condensate (y axis vs. temperature (x axis).

In the presence of water and heat (300° to 650° F.) hydrolysis of the chloride metal salts occurs according to the following three typical reactions:

Magnesium Chloride: $MgCl_2+2H_2O \rightarrow Mg(OH)_2+2HCl$

Calcium Chloride: $CaCl_2+2H_2O \rightarrow Ca(OH)_2+2HCl$

Sodium Chloride: $NaCl+H_2O \rightarrow NaOH+HCl$

The hydrolysis of the three metal chlorides in mineral oil is shown in FIG. 1. The samples contained 210 ppm Cl as $Mg\ Cl_2.6H_2O$, 244 ppm Cl as $CaCl_2.2H_2O$ and 1450 ppm Cl as NaCl. The hydrolysis rates for sodium and calcium chlorides are observed to be very low while the hydrolysis rate for magnesium chloride hexahydrate goes through a maximum at between 400° F. and 500° F., and is likely to be caused as a result of magnesium hydroxychloride, a stable form of chloride, which, on formation tends to slow down the hydrolysis rate.

Figure 2:
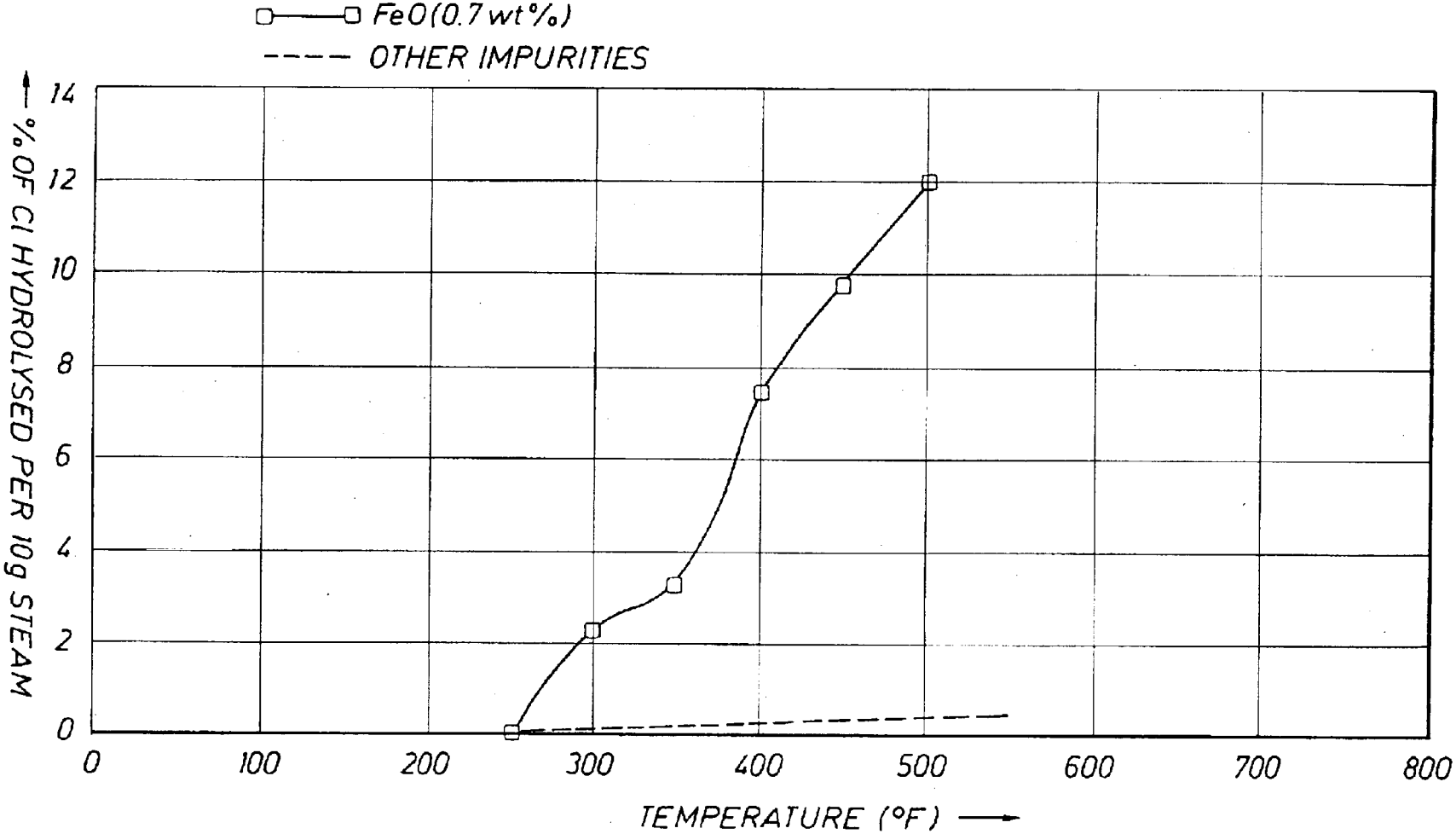
FIG. 2 is a graph showing the effect of various contaminants on the hydrolysis of calcium chloride in mineral oil as a function of temperature.

The overall efficiency of the hydrolysis of metal chloride to hydrochloric acid was determined with respect to the contaminants, which may act either as catalyst or inhibitors for the reaction. The most important contaminant is naphthenic acid, which caused a tenfold increase in the hydrolysis of sodium and calcium chloride. The effect of all other contaminants is naphthenic acid, as shown in FIG. 2. In addition to naphthenic acid other contaminants were 0.7 wt. % Fe O, 1.0 wt. % Fe S, 0.6 wt. %, $S10_2$ and 2.0 wt. % drilling mud.

Figure 3:
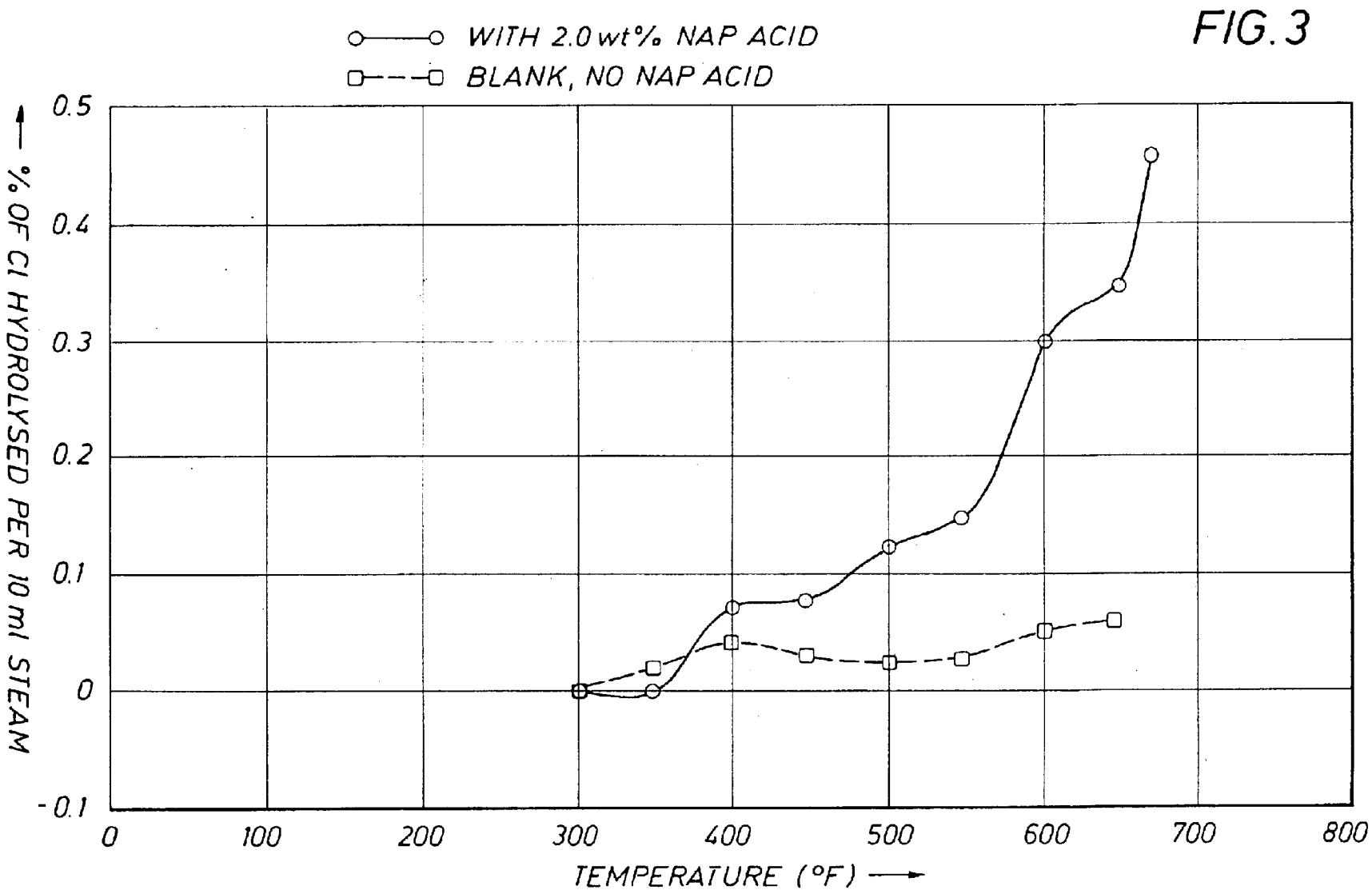
FIG. 3 is a graph showing the hydrolysis of sodium chloride in mineral oil in the presence of naphthenic acid as a function of temperature.

FIG. 3 demonstrates the power of naphthenic acid to accelerate the hydrolysis of sodium chloride, a normally stable salt.

EXAMPLE 1

Figure 4:
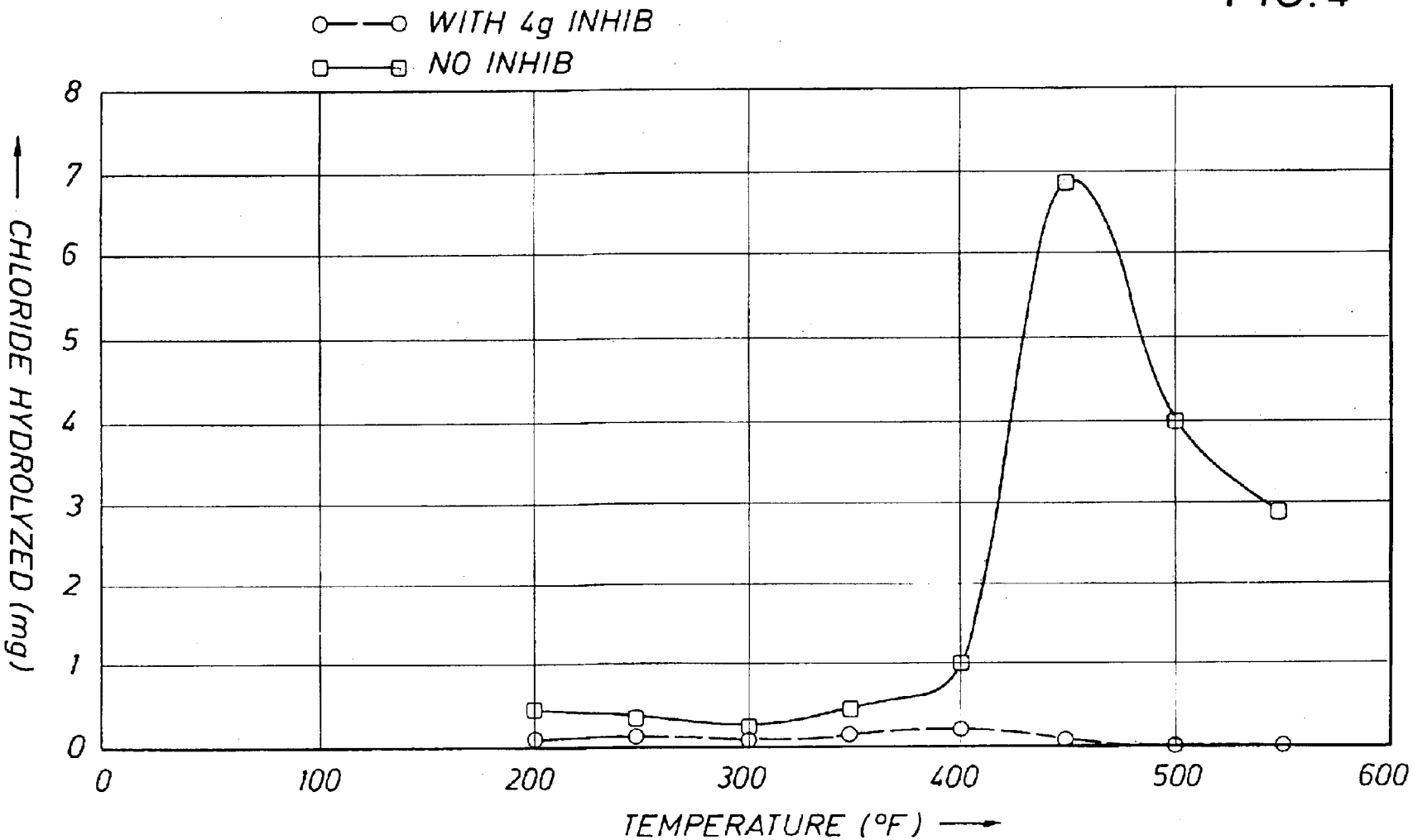
FIG. 4 is a graph showing the inhibition of hydrolysis of calcium chloride using the method of the present invention and FIG. 5 is a graph showing the inhibition of mixed chloride salts in mineral oil using the method of the present invention.

This example demonstrates the effectiveness of using the method of the present invention to reduce the hydrolysis of calcium chloride in a hydrocarbon base such as diluted bitumen. In one case, diluted bitumen containing 0.291 grams of calcium chloride, but no treating agent (inhibitor) was subjected to steam distillation as per the method described above. In the second case, the same diluted bitumen blend, together with 4 g of a treating agent inhibitor which was a calcium overbase having a total base number of 400 was also subjected to steam distillation. The results are shown graphically in FIG. 4. As can be seen, with no inhibitor significant hydrolysis of the calcium chloride occurred at a temperature of 450°. This is to be contrasted with the sample that contained the treating agent in which no significant hydrolysis of the calcium chloride was observed.

EXAMPLE 2

Figure 5:
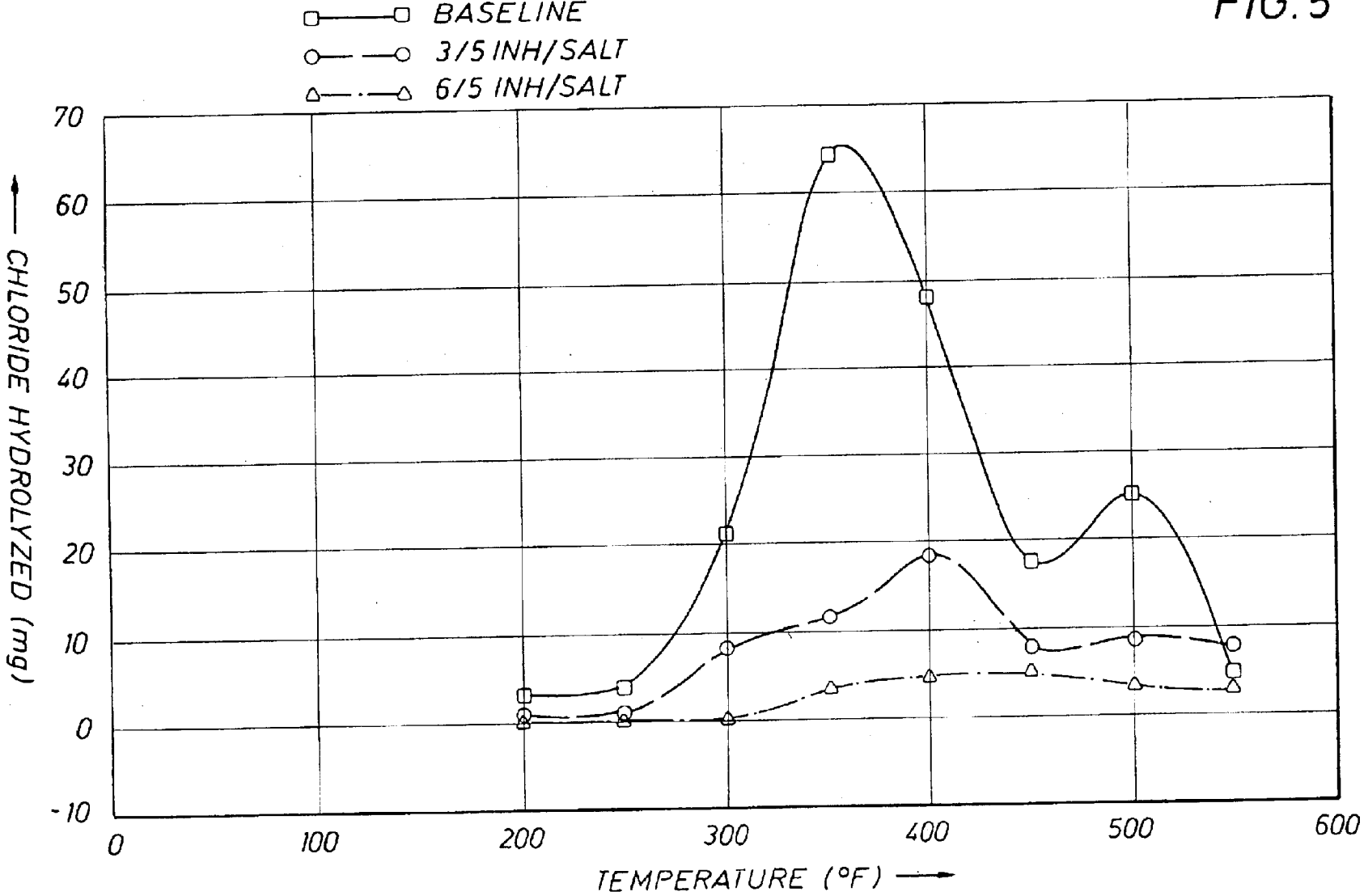

This example demonstrates the ability of the method of the present invention to prevent the hydrolysis of mixed chloride salts in a synthetic crude. The synthetic crude was as described above, e.g., mineral oil containing iron oxide, iron sulfide, silica and drilling mud in the amounts shown in FIG. 2. The total volume of mineral oil was 800 ml. which contained 3.5 g. sodium chloride, 1.0 g. calcium chloride, 0.5 g. magnesium chloride, and 8 g. of naphthenic acid. The treating agent employed was a magnesium overbase compound having a total base number of 600. A sample of the synthetic crude with the chloride salts and no treating agent was subjected to steam stripping as described above. A second sample was also subjected to steam stripping, except in this case, there were three parts of inhibitor for five parts of combined chloride salts. A third experiment was conducted in which there were six parts of inhibitor for five parts of combined salts. The results are shown in FIG. 5. As can be seen from the data in FIG. 5, without any treating agent, hydrolysis of the chlorides in the synthetic crude commenced at a roughly 250–300° F. With three parts of treating agent per five parts of salts present, hydrolysis was greatly reduced showing a peak at about 400° F. With six parts of treating agent per five parts of salts, hydrolysis was reduced to a point where minimum make of hydrochloric acid occurred.

What is claimed is:

1. A method for reducing hydrolysis in a hydrocarbon stream comprising introducing into a hydrocarbon stream containing a chloride compound which undergoes hydrolysis at elevated temperatures and in the presence of water to form hydrochloric acid, an effective amount of a treating agent comprising at least one overbase complex of a metal salt and an organic acid complexing agent, said treating agent being introduced into said hydrocarbon stream when said stream is at a temperature below which any substantial hydrolysis of said chloride containing compound occurs.

2. The method of claim 1 wherein said hydrocarbon stream is selected from the group consisting of: crude oil, shale oil and coal oil.

3. The method of claim 2 wherein said hydrocarbon stream comprises crude oil.

4. The method of claim 2 wherein said hydrocarbon stream comprises shale oil.

5. The method of claim 2 wherein said hydrocarbon stream comprises coal oil.

6. The method of claim 1 wherein said treating agent is added to said hydrocarbon stream at a temperature below about 400° F.

7. The method of claim 6 wherein, after said treating agent is added, said hydrocarbon stream is subjected to a temperature in the range of 600° to 750° F.

8. The method of claim 1 wherein said chloride compound comprises a metal chloride salt.

9. The method of claim 8 wherein said chloride salt compound comprises a chloride of an alkali or alkaline earth metal.

10. The method of claim 1 wherein said metal salt is a magnesium salt.

11. The method of claim 10 wherein said complex is an oil stable, colloidal dispersion.

12. The method of claim 11 wherein said complex forms a colloidal dispersion in said hydrocarbon stream.

13. The method of claim 10 wherein said metal salt is an oxide or carbonate of magnesium.

14. The method of claim 10 wherein the organic acid complexing agent is a carboxylic acid, a sulfur acid, or a phosphorus acid.

15. The method of claim 10 wherein the treating agent is a complex of a magnesium salt and a magnesium salt of an organic acid complexing agent.

16. The method of claim 1 wherein said hydrocarbon stream contains a naphthenic acid.

* * * * *